US005967800A

United States Patent [19]

Bishop

[11] Patent Number: 5,967,800

[45] Date of Patent: Oct. 19, 1999

[54] ELECTRICAL CONNECTORS

[75] Inventor: Peter George Bishop, Cambs, United Kingdom

[73] Assignee: AVX Limited, Suffolk, United Kingdom

[21] Appl. No.: 08/973,765

[22] PCT Filed: Jun. 26, 1996

[86] PCT No.: PCT/GB96/01534

§ 371 Date: Dec. 8, 1997

§ 102(e) Date: Dec. 8, 1997

[87] PCT Pub. No.: WO97/02631

PCT Pub. Date: Jan. 23, 1997

[30] Foreign Application Priority Data

Jul. 4, 1995 [GB] United Kingdom ..... 9513540

[51] Int. Cl.[6] ..... H01R 9/09

[52] U.S. Cl. ..... 439/74; 439/66

[58] Field of Search ..... 439/66, 74

[56] References Cited

U.S. PATENT DOCUMENTS

| | | | |
|---|---|---|---|
| 3,550,062 | 12/1970 | Drenten et al. . | |
| 3,815,077 | 6/1974 | Anhalt et al. . | |
| 3,873,173 | 3/1975 | Anhalt | 439/71 |
| 3,960,424 | 6/1976 | Weisenburger . | |
| 3,993,384 | 11/1976 | Dennis et al. | 439/71 |
| 4,035,046 | 7/1977 | Kloth . | |
| 4,050,755 | 9/1977 | Hasircoglu . | |
| 4,052,118 | 10/1977 | Scheingold et al. . | |
| 4,057,311 | 11/1977 | Evans . | |
| 4,093,330 | 6/1978 | Pittman . | |
| 4,176,895 | 12/1979 | Aldridge | 439/71 |
| 4,188,085 | 2/1980 | Aldridge et al. | 439/525 |
| 4,220,383 | 9/1980 | Scheingold et al. . | |
| 4,268,102 | 5/1981 | Grabbe | 439/331 |
| 4,341,433 | 7/1982 | Cherian et al. | 439/71 |
| 4,359,252 | 11/1982 | Olsson et al. . | |
| 4,494,807 | 1/1985 | Cosmo | 439/68 |
| 4,511,201 | 4/1985 | Baker et al. . | |
| 4,553,192 | 11/1985 | Babuka et al. . | |
| 4,660,920 | 4/1987 | Shibano | 439/631 |
| 4,664,458 | 5/1987 | Worth . | |
| 4,806,104 | 2/1989 | Cabourne | 439/66 |
| 4,927,369 | 5/1990 | Grabbe et al. . | |
| 4,995,814 | 2/1991 | Weidler | 439/61 |
| 4,998,886 | 3/1991 | Werner | 439/66 |
| 5,041,016 | 8/1991 | Machado et al. | 439/502 |
| 5,052,943 | 10/1991 | Davis . | |
| 5,199,889 | 4/1993 | McDevitt, Jr. | 439/66 |
| 5,226,826 | 7/1993 | Nillson et al. | 439/72 |

(List continued on next page.)

FOREIGN PATENT DOCUMENTS

| | | |
|---|---|---|
| 0346206A1 | 12/1989 | European Pat. Off. . |
| 0463487B1 | 1/1992 | European Pat. Off. . |
| 9112605 | 2/1992 | Germany . |
| 435363 | 3/1992 | Japan . |
| 454111 | 5/1992 | Japan . |

OTHER PUBLICATIONS

UK Search Report Dated Feb. 3, 1999.

International Preliminary Examination Report Dated Oct. 13, 1997.

*Primary Examiner*—Neil Abrams
*Assistant Examiner*—T C Patel
*Attorney, Agent, or Firm*—Dority & Manning, P.A.

[57] ABSTRACT

An electrical connector for interconnecting circuit boards has an insulating body with adjacently disposed recesses defined along at least one of its sides and open at the sides. A connector element is disposed in each of the recesses having a contact foot extending outwardly from the recess for mounting to one circuit board and a movable contact head extending above an uppermost face of the insulating body for being resiliently pressed into contact with another circuit board. The connector element includes a flexible stem portion between the contact head and a horizontal portion mounted to the insulating body such that the flexible stem portion bends back over the mounted portion only once.

13 Claims, 3 Drawing Sheets

U.S. PATENT DOCUMENTS 5,230,632 7/1993 Baumberger et al. ..... 439/66
5,234,353 8/1993 Scholz et al. .
5,259,769 11/1993 Cruise et al. .
5,306,163 4/1994 Asakawa .
5,308,252 5/1994 Mroczkowski et al. ..... 439/66
5,310,352 5/1994 Mroczkowski et al. ..... 439/76.1
5,378,160 1/1995 Yumibe et al. ..... 439/66
5,584,713 12/1996 Kato et al. ..... 439/188
5,586,890 12/1996 Braun ..... 439/66

ELECTRICAL CONNECTORS

FIELD OF INVENTION

The present invention relates to electrical connectors and more particularly to electrical connectors used to interconnect electronic assemblies such as, for example, printed circuit boards, which are required to he mounted one adjacent another, often, but not necessarily, in a vertically-arranged stack. Such electronic assemblies will be referred to herein as "boards".

BACKGROUND TO THE INVENTION

Apart from hard wiring the boards one to another, prior art methods of interconnecting the boards include the use of edge connectors carried by the boards which engage with complementary fixed connectors carried within a frame mounting the boards, interconnection being required between the complementary fixed connectors to provide the necessary connections from one board to another.

Such systems are inconvenient and costly, requiring numerous individual component parts, and the assembly of those parts into an interconnection system. In addition, removal or replacement of individual boards of an assembly is likely to difficult and thus introduce further cost in service and maintenance.

It is an object of the present invention to provide an improved means of interconnecting boards as herein defined.

SUMMARY OF THE INVENTION

According to the present invention electrical connection means for interconnecting two physically adjacent boards, as herein defined, comprises an electrically insulating body which mounts one or more electrically conducting elements, each such conducting element having a first portion adapted to electrically contact an electrically conducting part of one board, and a second portion adapted to contact an electrically conducting part of an adjacent board, to provide electrical connection therebetween.

One of said portions may be adapted to be physically attached to the electrically conducting part of its respective board, and the other of said portions to form a pressure contact with the electrically conducting part of the other board.

Alternatively the body of the connector may be physically attached to, or located upon, one or other of the two boards and pressure contact made by both portions of the connector element to the respective conducting parts of the two boards.

In one form of connector in accordance with the invention, the insulating body of the connector may lie between the boards to be interconnected, and connection may be made between contacts carried respectively by the opposed faces of the two boards.

In a further form, the boards to be interconnected may lie one upon the other, and connection may be made between contacts carried respectively upon the upper faces of the two boards.

Employing a series of connectors in accordance with the invention, a series of boards may be interconnected in stack without the need for an external mechanical framework or associated interconnections.

It will be apparent that connectors in accordance with the invention provide a more ready and less expensive means of interconnecting adjacent boards one to another, and of creating an interconnected stack of a series of such boards.

BRIEF DESCRIPTION OF DRAWINGS

In order that features and advantages of the present invention may be further appreciated, two embodiments thereof will be described, by way of example, with reference to the accompanying drawings of which.

DETAILED DESCRIPTION OF EMBODIMENTS

Figure 1:
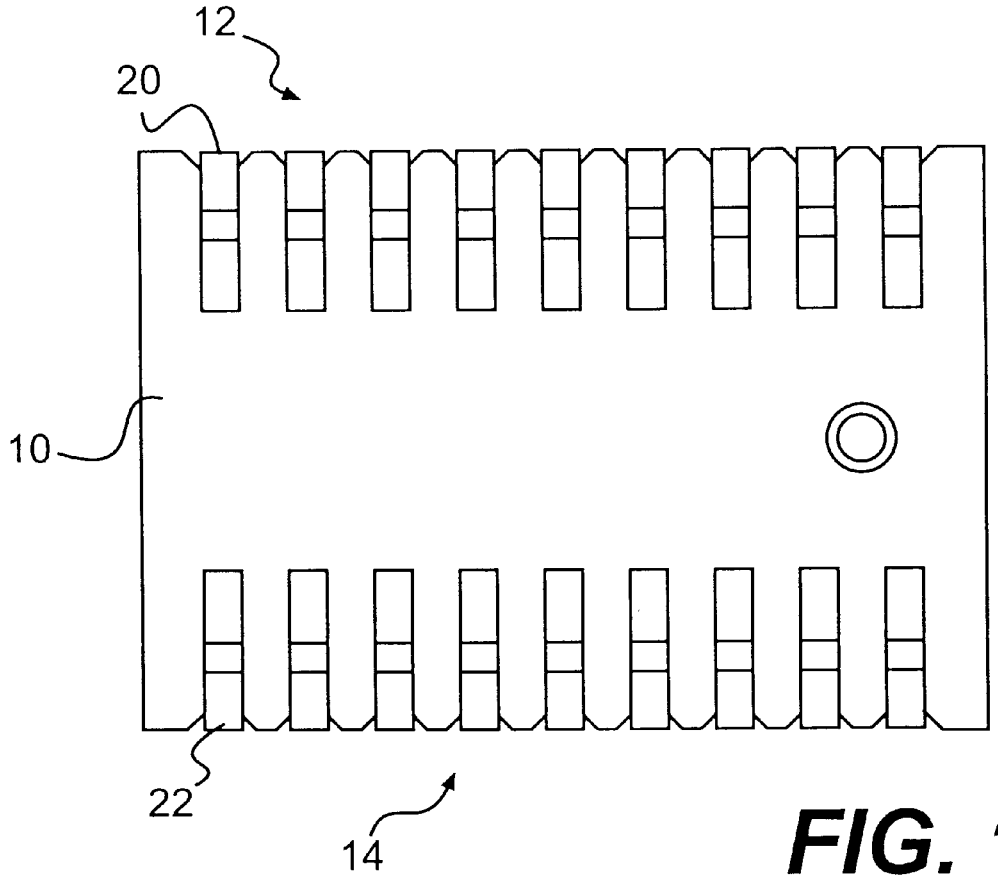
FIGS. 1, 2 and 3 show respectively views from the top, side and below of an electrical connector in accordance with the invention.
Figure 2:
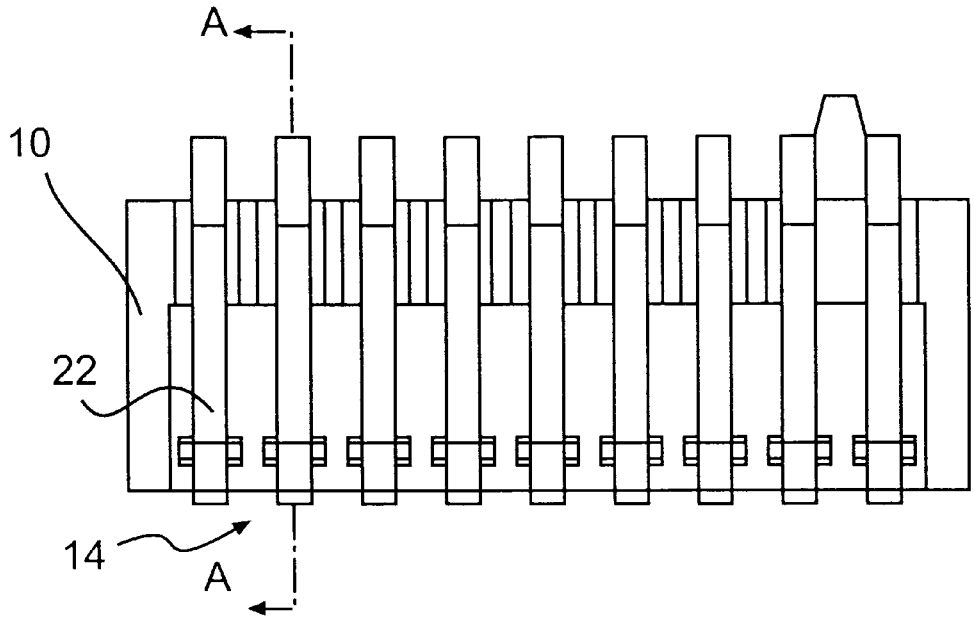
Figure 3:
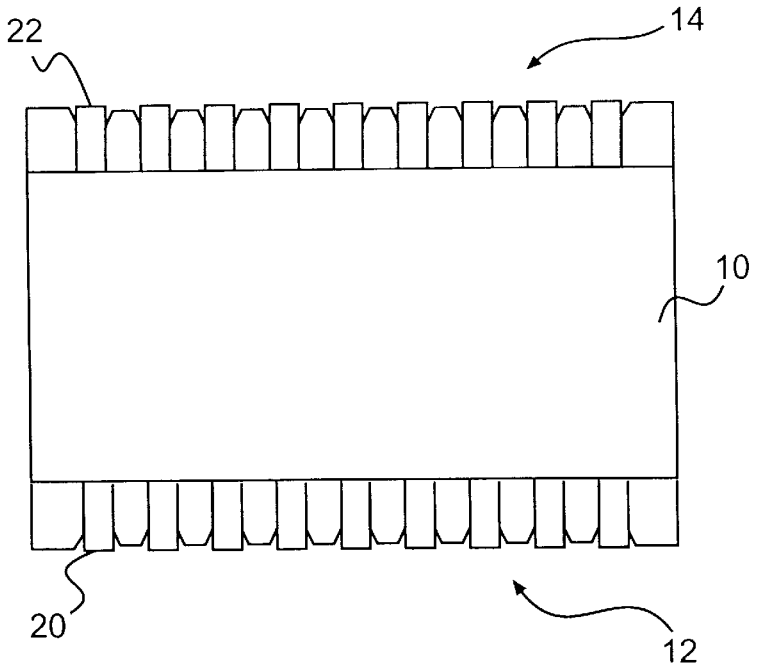
Figure 4:
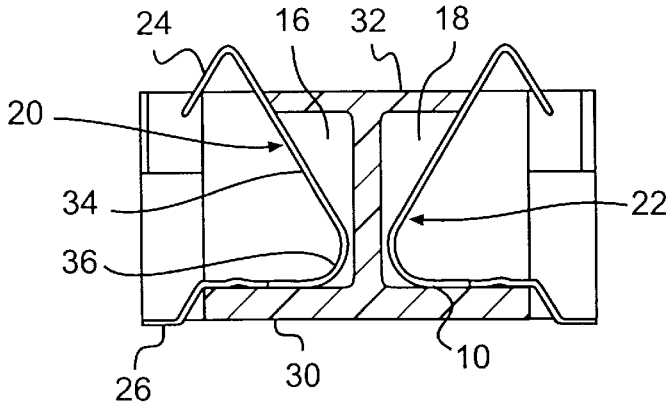
FIG. 4 is a transverse section through the connector of FIGS. 1, 2 and 3, taken along the line A—A, looking in the direction of the arrows.
Figure 5:
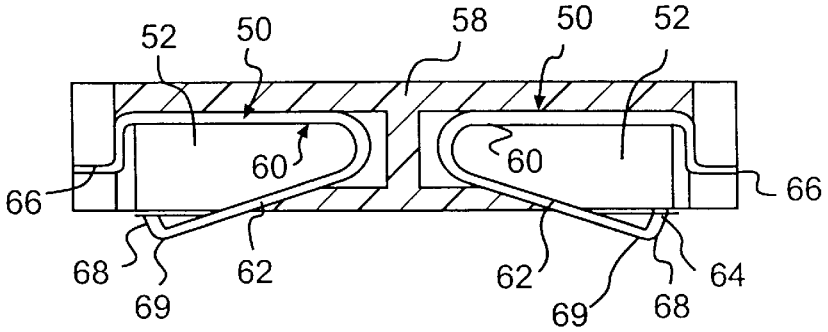
FIG. 5 is a transverse section of another form of connector in accordance with the invention.
Figure 6:
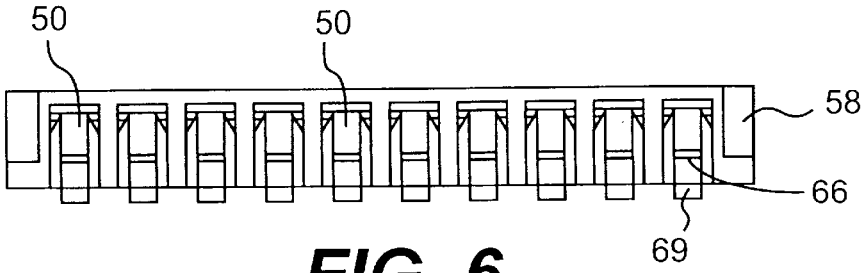
FIGS. 6 & 7 are views or the connector of FIG. 5 from one side and below respectively, on a different scale.
Figure 7:
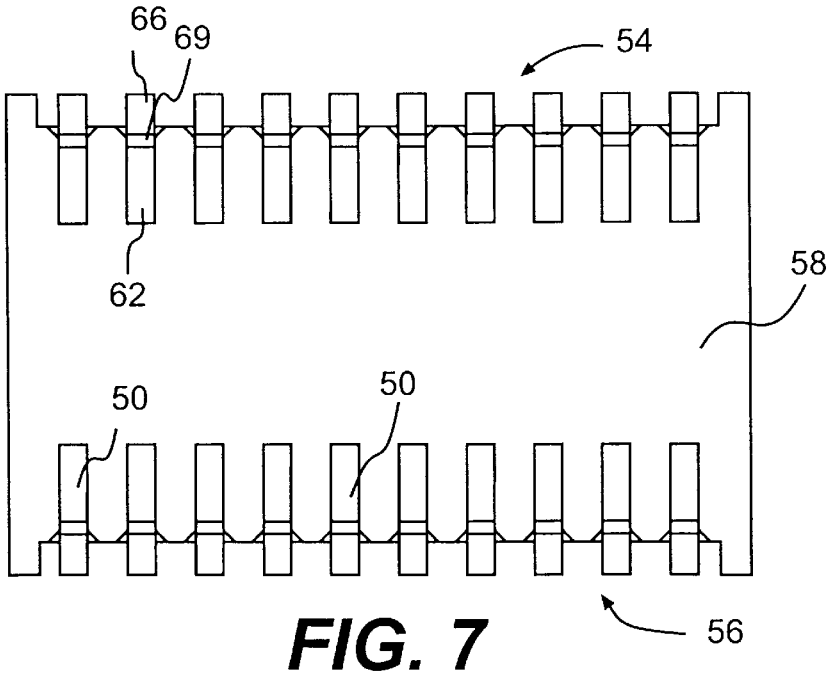

Referring to FIGS. 1 to 4, the first electrical connector comprises a body 10 of electrically insulating material in the form of a plastics moulding, whose opposed longitudinal faces 12 and 14 are each provided with a series of opposed recesses, such as 16 and 18 respectively (see FIG. 4), in which identical contact elements such as 20 and 22 are mounted.

The body 10 may typically be moulded of STANYL (TM) high temperature resistant nylon 46, and the contact elements 20 formed of beryllium-copper strip material 0.1 mm thick.

Each contact element is shaped to provide a head 24 in the form of an inverted letter V at the upper extremity of the contact element and a flat foot 26 at the lower extremity.

Head 24, which is intended to make pressure contact with a contact pad upon one printed circuit board is gold plated to optimise electrical contact between contact element 20 and the respective contact paid, carried upon the board to be mounted adjacent the upper face 32 of body 10.

Foot 26, which is intended to be surface mounted by soldering to a contact pad upon the other printed circuit board, is tinned with a tin-lead alloy to permit ready attachment thereto.

Each contact element 20 is shaped and mounted to permit head 24 to flex outwardly and downwardly upon stem 34, about turnover 36, when assembled with an upper printed circuit board, the lower face of which will lie in contact with the upper face 32 of moulding 10, when the upper board is pressed into contact with the connector.

Referring now to the further connector shown in FIGS. 5 to 8 of the drawings, a series of contact elements 50, are mounted within recesses 52 arranged in two opposed rows 54 and 56, one on each side of a body moulding 58 of electrically insulating material.

Each contact element 50 comprises a generally V-shaped portion, one limb 60 of which lies in contact with the upper face of the recess 52, and the other 62 partly projects through the inerture slot 64 in the lower face of recess 52.

The end-portion of limb 60 is continued and stepped to provide a foot 66, intended to be surface mounted upon a complementary contact carried by one of the two boards to be interconnected, and the end portion 68 of limb 62 is bent upwardly toward the recess 52. to provide a sprung contact face 69 to engage a complementary contact carried by the other of the two boards to be interconnected.

Figure 8:
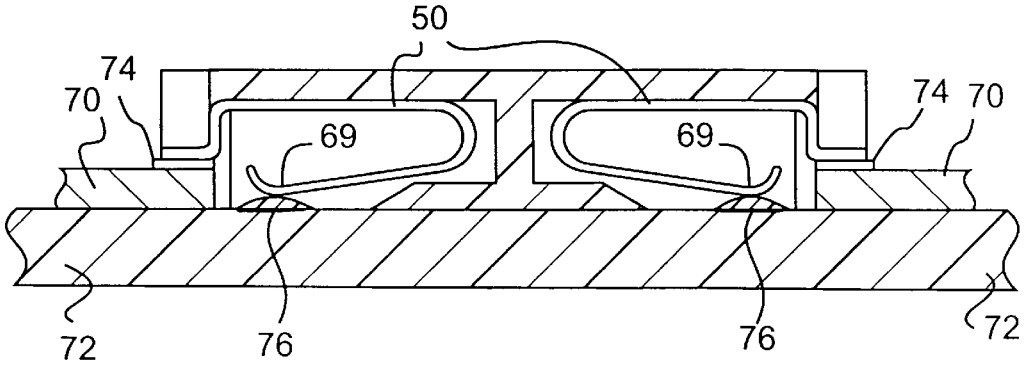
FIG. 8 is a further transverse view of the connector of FIG. 5 assembled with, and interconnecting two boards.

FIG. 8 shows the same connector assemnbled with a pair of boards 70 and 72, with appropriately positioned contact pads 74 and 76 respectively, on the upper surface of each, to permit interconnection by means of the contact elements 50.

The end portion 68 of each contact element 50 projects through aperture 64, and allows contact faces to contact pads 76 upon the upper face of board 72, the lower part of connector body 58 projecting through an appropriately dimensioned aperture in the upper board 70, to mechanically contact the upper face of lower board 72.

It will he appreciated that the connector described in relation to FIGS. 5 to 8 of the drawings will normally be carried upon the upper board 70 by virtue of the contact feet 66 being surface mounted by solder attachment to contact pads 74, and, upon assembly of the two boards 70 and 72, contact faces 69 will engage pads 76 upon the lower board 72. The complete assembly may be held together by appropriately mounting board 70 to board 72, for example by interengaging pegs and apertures, or otherwise.

I claim:

1. An electrical connector for interconnecting at least a first circuit board to a second circuit board, comprising:

an insulating body having an upper portion defining an uppermost first face configured for disposition adjacent a face of a first circuit board, a lower portion defining a bottommost face, and longitudinal sides, said insulating body further defining adjacently disposed recesses defined in at least one of said sides, said recesses being at said side and defined between inner surfaces of said upper and lower portions;

a connector element disposed in each of said recesses, each said connector element having a first end and a second end, and further comprising:

a contact foot defined generally at said second end extending outwardly from said recess and disposed for contact mounting to a second circuit board;

a generally horizontal mounted portion intermediate said first and second ends disposed within said recess and mounted directly against an inner surface of said recess lower portion.

a resiliently movable contact head defined generally at said first end and disposed above a plane of said uppermost first face, said contact head movable towards said uppermost first face upon being pressed into mating contact with the first circuit board; and a flexible stem portion extending between said horizontal mounted portion and said contact head, said flexible stem portion bent back over said horizontal mounted portion only once between said horizontal mounted portion and said contact head.

2. The connector as in claim 1, wherein said flexible stem portion comprises a single turnover section directly adjacent said horizontal mounted portion where said flexible stem portion bends back over said horizontal mounted portion.

3. The connector as in claim 2, wherein said flexible stem portion is essentially straight between said turnover section and said contact head.

4. The connector as in claim 3, wherein flexible stem portion extends at an angle of generally less than ninety degrees relative to said horizontal mounted portion.

5. The connector as in claim 1, wherein said flexible stem portion is bent back over said horizontal mounted portion at a single turnover section that is disposed within said recess such that said flexible stem portion and said horizontal mounted portion define an outwardly facing open-ended configuration.

6. The connector as in claim 5, wherein said flexible stem portion and said horizontal mounted portion define a generally V-shaped open-ended configuration.

7. The connector as in claim 5, wherein said flexible stem portion extends above said uppermost first face and is resiliently disposed directly against said upper portion of said insulating body where said flexible stem portion extends out of said recess.

8. The connector as in claim 1, wherein said insulating body comprises a row of said adjacently disposed recesses defined in each of said sides with a respective said connector element disposed in each said recess.

9. The connector as in claim 8, wherein said insulating body is generally symmetrical about a plane extending between said rows of adjacently disposed recesses.

10. The connector as in claim 1, wherein said contact foot of each said connector comprises a contacting surface facing in an opposite direction from said contact head.

11. The connector as in claim 10, wherein said bottommost face of said insulating body is configured for disposition adjacent a face of the second circuit board, said contact foot of each said connector extending sufficiently beyond a plane of said bottommost face so that said contact feet make electrical connection with mating pads of the second circuit board upon said bottommost face being disposed directly adjacent the face of the second circuit board, said connector thereby disposed between the first and second circuit boards.

12. The connector as in claim 1, wherein said contact foot of each said connector comprises a contacting surface facing in the same direction as said contact head.

13. The connector as in claim 12, wherein said contact foot of each said connector extends outward from said insulating body between planes through said uppermost and bottommost faces so that said contact feet make electrical connection with mating pads of the second circuit board.

* * * * *